US009302888B2

(12) United States Patent
Bahlatzis et al.

(10) Patent No.: US 9,302,888 B2
(45) Date of Patent: Apr. 5, 2016

(54) SYSTEM AND METHOD FOR LIFTING AN ELECTRONICS PANEL

(71) Applicant: General Electric Company, Schenectady, NY (US)

(72) Inventors: Jonathan Daniel Bahlatzis, Lafayette, CO (US); David Christopher Burbank, Boxford, MA (US); Tony Allen Harrington, Windsor, CO (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 239 days.

(21) Appl. No.: 13/938,172

(22) Filed: Jul. 9, 2013

(65) Prior Publication Data

US 2015/0016942 A1 Jan. 15, 2015

(51) Int. Cl.
*B66C 1/00* (2006.01)
*B66C 1/10* (2006.01)

(52) U.S. Cl.
CPC ..... *B66C 1/10* (2013.01)

(58) Field of Classification Search
CPC ..... B66C 1/62; B66C 1/16; B66C 1/32; B66C 1/24; B66C 1/12; B66C 1/663; B66C 1/10; B66C 13/08; B66C 1/64; B66C 1/54; E21B 19/06; B25J 15/026
See application file for complete search history.

(56) References Cited

U.S. PATENT DOCUMENTS

| | | | | |
|---|---|---|---|---|
| 1,769,134 | A * | 7/1930 | Haff | 294/67.3 |
| 3,427,066 | A * | 2/1969 | Kugler | 294/67.3 |
| 3,828,942 | A | 8/1974 | Young | |
| 5,242,249 | A | 9/1993 | Grayson | |
| 5,460,469 | A | 10/1995 | Young | |
| 5,732,527 | A | 3/1998 | Schneider | |
| 6,056,499 | A * | 5/2000 | Bressner | 414/621 |
| 6,769,655 | B2 | 8/2004 | Beese | |
| 6,860,531 | B2 * | 3/2005 | Sherwin | 294/2 |
| 7,021,606 | B2 | 4/2006 | Raycraft | |
| 7,300,084 | B2 * | 11/2007 | Chae et al. | 294/119.1 |
| 7,448,598 | B1 | 11/2008 | Elmlinger et al. | |
| 8,408,616 | B2 * | 4/2013 | Yeum et al. | 294/86.4 |
| 8,556,311 | B1 * | 10/2013 | Lucero | 294/67.33 |

* cited by examiner

*Primary Examiner* — Stephen Vu
(74) *Attorney, Agent, or Firm* — Fletcher Yoder P.C.

(57) ABSTRACT

A system includes a lift member configured to removably couple with a lifting device and a support member coupled to the lift member. The support member includes a first arm having a first end portion configured to removably engage a first section of an electronics panel, and a second arm having a second end portion offset by an arm distance from the first end portion. The second end portion is configured to selectively move to adjust the arm distance to removably engage a second section of the electronics panel opposite to the first section. The first and second end portions are configured to engage the electronics panel in a first orientation, to support the electronics panel during a transition to a second orientation, and to disengage the electronics panel in the second orientation.

20 Claims, 6 Drawing Sheets

SYSTEM AND METHOD FOR LIFTING AN ELECTRONICS PANEL

BACKGROUND OF THE INVENTION

The subject matter disclosed herein relates to a system and method for lifting a panel, such as for installation in a control cabinet.

Control systems may utilize control modules to monitor and control a communicatively coupled system, such as a power generation system. Multiple control modules may be installed in control cabinets by coupling the control modules to panels. Control modules may be assembled and configured on the panels outside the control cabinet prior to installation. Assembly or configuration of the control modules is performed while the panels are in a horizontal orientation; however, panels may be installed in a vertical orientation within control cabinets. Unfortunately, it may be difficult for one operator to change the orientation of the panel to install the panel in the control cabinet due to the size or weight of the panel with the control modules. Moreover, the panel may be difficult to lift without adding to the panel geometry or affecting the functionality of the control modules.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a lift member configured to removably couple with a lifting device and a support member coupled to the lift member. The support member includes a first arm having a first end portion configured to removably engage a first section of an electronics panel, and a second arm having a second end portion offset by an arm distance from the first end portion. The second end portion is configured to selectively move to adjust the arm distance to removably engage a second section of the electronics panel opposite to the first section. The first and second end portions are configured to engage the electronics panel in a first orientation, to support the electronics panel during a transition to a second orientation, and to disengage the electronics panel in the second orientation.

In a second embodiment, a system includes a lift member configured to removably couple with a lifting device and a support member coupled to the lift member. The support member includes a first arm, a second arm, and an actuation system. The first arm extends along a first axis and has a first end portion having a first retaining feature configured to removably engage a first section of an electronics panel. The second arm extends along a second axis and has a second end portion having a second retaining feature configured to removably engage a second section of the electronics panel opposite to the first section. The actuation system is coupled to the second arm and is configured to move the second end portion along the second axis to adjust an offset distance relative to the first end portion to selectively engage and disengage the second retaining feature. The first retaining feature and the second retaining feature are configured to engage the electronics panel in a horizontal orientation, to support the electronics panel during a transition to a vertical orientation, and to disengage the electronics panel in the vertical orientation.

In a third embodiment, a method includes positioning a lift assembly proximate to an electronics panel in a first orientation, engaging a first retaining feature of the lift assembly with a first set of multi-purpose features of a first section of the electronics panel at a first end of the electronics panel, and engaging a second retaining feature of the lift assembly with second set of multi-purpose features of a second section of the electronics panel opposite the first section at the first end of the electronics panel. The method also includes lifting the first end of the electronics panel via the lift assembly from the first orientation to a second orientation and disengaging the first retaining feature and the second retaining feature from the first end of the electronics panel.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
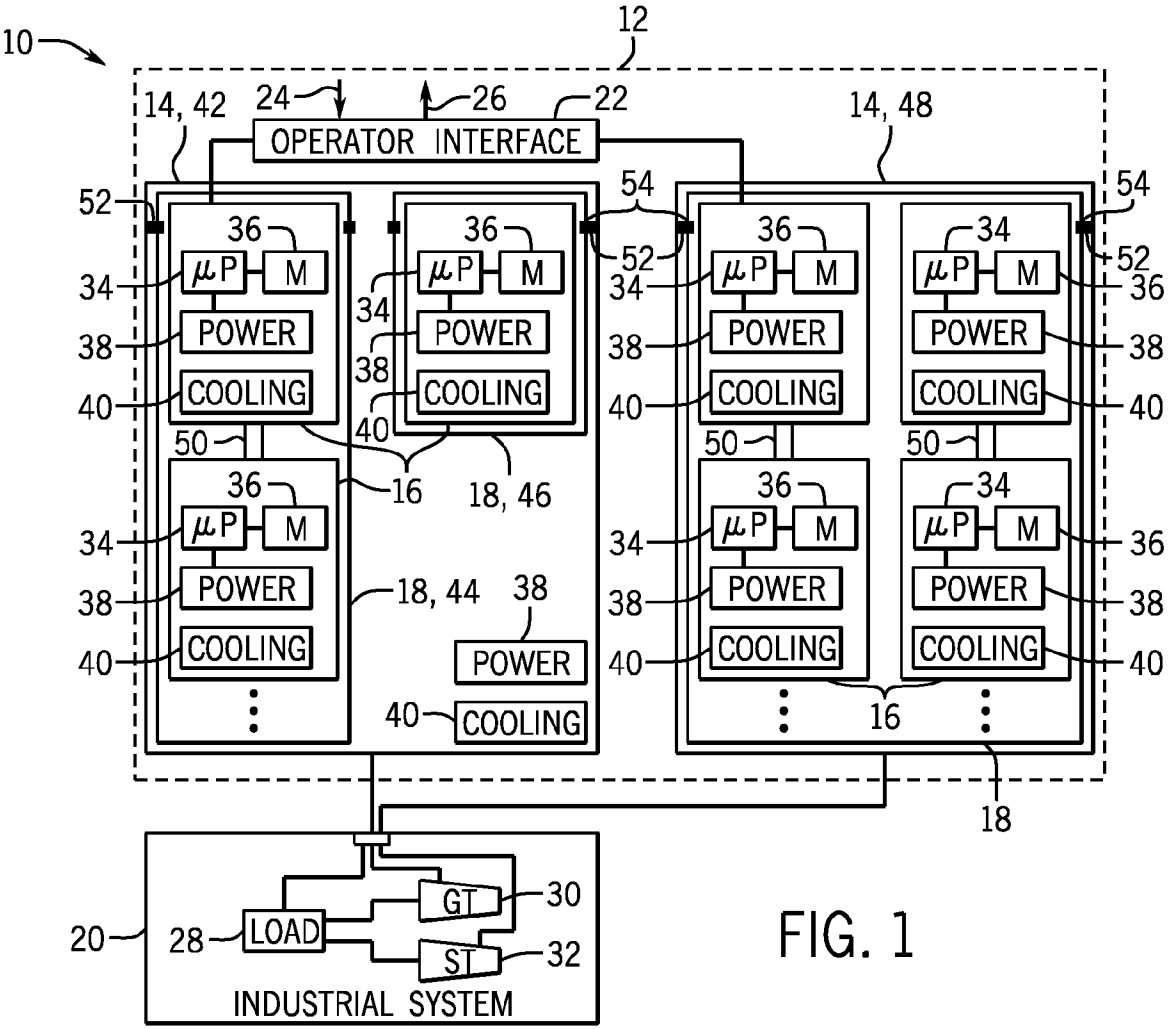
FIG. 1 is a block diagram of a system having a control system with control cabinets and control modules on electronics panels to control and monitor an industrial system.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure relates to an electronics panel lift assembly that may be utilized to lift an electronics panel from a first orientation (e.g., horizontal) to a second orientation (e.g., vertical). The electronics panel lift assembly may engage multi-purpose geometries (e.g., recesses, holes, edges) of the electronics panel with one or more arms, thereby enabling the electronics panel to be installed without the addition of particular lift components (e.g., lift eyes, support members, holes only for lifting) to the panel. For example, the lift assembly may engage the recesses on an edge of the electronics panel to lift the electronics panel into a vertical orientation in a control cabinet. The electronics panel may be mounted to the cabinet via the recesses previously engaged by the electronics lift assembly. The lift assembly may not interact with components mounted on the inside surface of the electronics panel. The one or more arms may actuate along an axis to engage and disengage opposite sections of the electronics panel. The one or more arms may be actuated via a pneumatic, hydraulic, electrical, and/or mechanical actuation system. In some embodiments, the lift assembly may be adjusted to accommodate engagement with electronics panels of various widths. Moreover, the lift points of the lift assembly may be adjusted to accommodate various weights and centers of gravity of the electronics panels. In some embodiments, a single operator may utilize the lift assembly to raise an electronics panel from a horizontal orientation to a vertical orientation for installation in a control cabinet. The horizontal orientation may be convenient for assembly and configuration of control modules, power supplies, and cooling systems, while the vertical orientation may be convenient for operation because the vertical oriented electronics panel has a relatively smaller foot print. Accordingly, the lift assembly may reduce the assembly time and operator effort associated with assembly of control cabinets, thereby reducing costs and increasing production speed. The lift assembly may securely lift the electronics panel along a vertical axis from above, thereby reducing the footprint for electronics panel installation at a work site.

Turning to the drawings, FIG. 1 is a block diagram of a system 10 having a control system 12 with control cabinets 14 and control modules 16. The control modules 16 are on electronics panels 18 to control and monitor an industrial system 20. The electronics panels 18 may include, but are not limited to, industrial control panels, turbine control panels, generator control panels, electronics control panels, electronic monitoring panels, and so forth. An operator may control the system 10 through an operator interface 22 that receives operator input 24 and provides various system outputs 26 to the operator. The control system 12 may have one or more control cabinets 14, and each control cabinet 14 may have one or more electronics panels 18. In some embodiments, each electronics panel 18 may have multiple control modules 16. The control modules 16 may send and receive signals with components of the industrial system 20. In some embodiments, the industrial system 20 may be a power generation system that provides power to a load 28. The load 28 may be driven by a gas turbine 30 and/or a steam turbine 32.

Each control module 16 may have a processor 34 and a memory 36. The memory 36 may be a non-transitory computer-readable media that may store data and/or instructions for processing data with the processor 34. The processors 34 execute instructions or code to monitor components of the industrial system 20 and to provide feedback to the operator via the operator interface 22. The processors 34 process signals received from the industrial system 20, other control modules 16, and/or the operator interface 22 to control the system 10. In some embodiments, each control module 16 of the control system 12 may monitor the industrial system 20 via sensors and/or control a different component (e.g., load, turbine, compressor, generator, engine, gasifier, or reactor) of the industrial system 20. Additionally, or in the alternative, each control module 16 may monitor and/or control a particular parameter (e.g., temperature, pressure, flow rate, clearance, vibration, or gas composition) of the one or more components of the industrial system 20. In some embodiments, a control module 16 may have a power supply 38 to provide power for operation of the processor 34. One or more control modules 16 may have a cooling system 40. Additionally, or in the alternative, each control cabinet 14 may have a shared power supply 38 to provide power to the respective control modules 16, and/or each control cabinet 14 may have a shared cooling system 40 to provide cooling for the control modules 16 within the control cabinet 14.

The control cabinets 14 of the control system 12 may have different sizes and configurations. For example, FIG. 1 illustrates an embodiment of a first control cabinet 42 with two electronics panels 18 (e.g., front panel 44 and back panel 46), and a second control cabinet 48 with one electronics panel 18. The electronics panels 18 may have one or more assembly features 50 (e.g., rails) to facilitate mounting of the control modules 16. In some embodiments, an electronics panel 18 (e.g., the panel 18 in the second control cabinet 44) with multiple assembly features 50 may be wider than an electronics panel 18 (e.g., the front and back panels 44, 46) with fewer assembly features 50.

One or more electronics panels 18 may be installed in each control cabinet 14. In some embodiments, fasteners 52 (e.g., threaded fasteners, bolts, screws, rivets) couple the electronics panels 18 to the control cabinets 14. For example, fasteners 52 may extend through recesses 54 (e.g., holes) to secure the one or more electronics panels 18 to the control cabinet 14. As discussed in detail below, a lift assembly may couple to or engage with the electronics panel 18 via an multi-purpose geometry (e.g., recess 54) of the electronics panel 18, thereby reducing steps to install the electronics panel 18 within the control cabinet 14. In some embodiments, lift assembly may not produce a magnetic field, thereby reducing the magnetic exposure of the control modules 16. The lift assembly may enable the electronics panel 18 to be raised from a first orientation (e.g., horizontal) for module assembly to a second orientation (e.g., vertical) for operation, or vice versa. The lift assembly may reduce the disruption of the electronics panel 18 and/or control modules 16 during installation.

Figure 2:
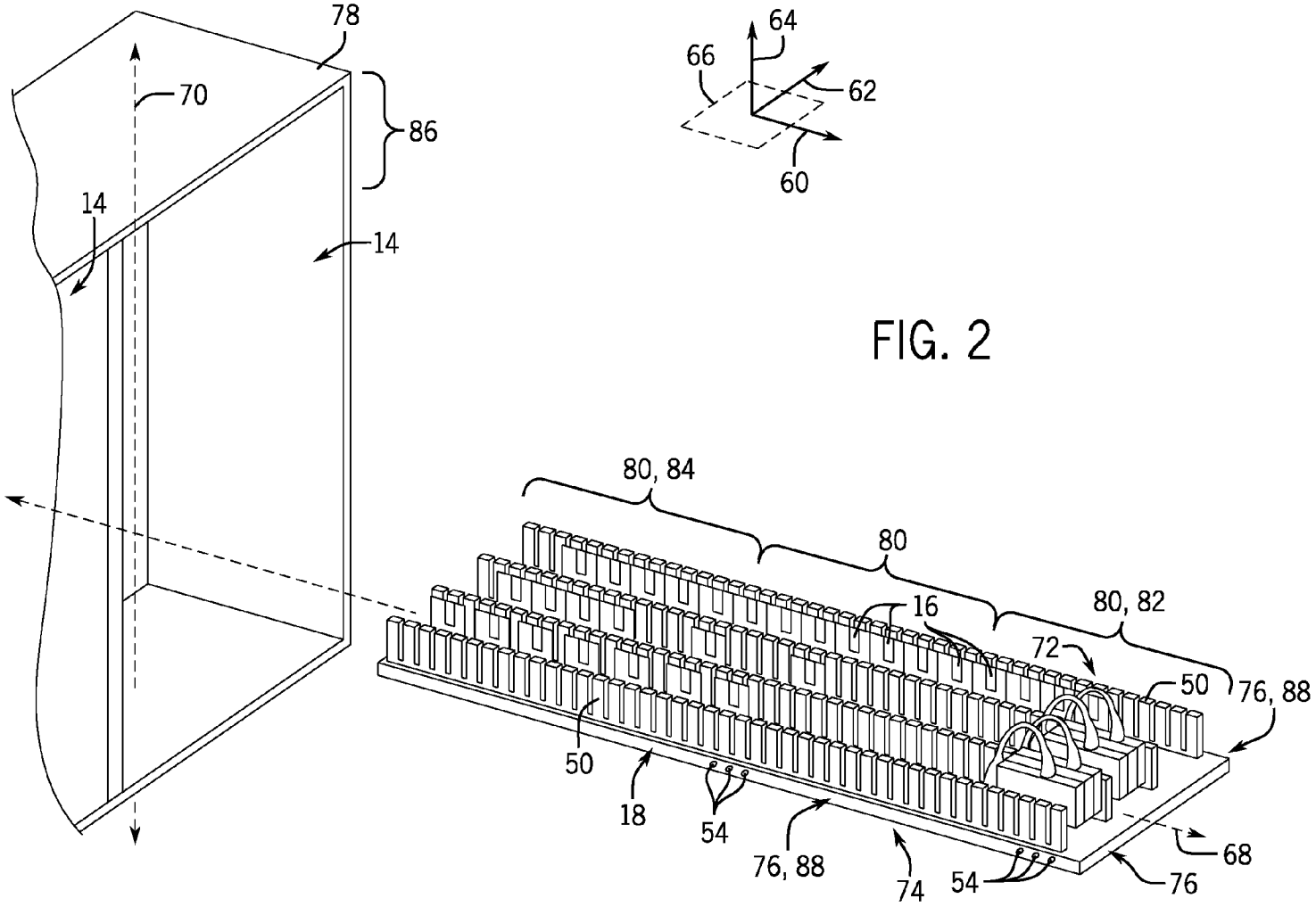
FIG. 2 is a perspective view of an embodiment of a panel with assembled control modules and a control cabinet.

FIG. 2 is a perspective view of an embodiment of an electronics panel 18 with control modules 16 to be installed in a control cabinet 14. The axes 60, 62, and 64 are utilized to describe directions relative to the control cabinet 14, where the X-axis 60 and the Z-axis 62 lie in a horizontal plane 66, and the Y-axis 64 extends in a vertical direction perpendicular to the horizontal plane 66. The electronics panel 18 may lie along a panel axis 68, and the control cabinet 14 may be oriented substantially along a cabinet axis 70. During operation of the control system 12, the control cabinet 14 may be arranged so that the cabinet axis 70 is substantially parallel to the vertical axis 64. The control modules 16 may be coupled to the assembly features 50 (e.g., rails) of the electronics panel 18 while the electronics panel 18 is in a horizontal orientation substantially parallel with the horizontal plane 66. The horizontal orientation may facilitate multiple operators assembling and/or configuring the control modules 16 on the electronics panel 18 at approximately the same time.

In some embodiments, one or more electronics panels 18 may form the exterior surfaces (e.g., front, back, sides) of the control cabinet 14. The control modules 16 may be assembled on an inside face 72 of the electronics panel 18, and an outer face 74 may form an exterior surface of the control cabinet 14. The one or more multi-purpose recesses 54 may be on edges 76 of the electronics panel 18. The fasteners 52 may be used to secure the edges 76 of the electronics panel 18 to a frame 78 of the control cabinet 14. In some embodiments, recesses 54 may be arranged on opposing edges 76, thereby enabling areas 80 (e.g., top, middle, bottom) of the electronics panel 18 to be separately secured to the frame 78. The recesses 54 may be arranged in groups (e.g., 2, 3, 4, or more recesses per area 80). A common pattern of recesses 54 may enable either a top area 82 or a bottom area 84 to be mounted to a top portion 86 of the control cabinet 14.

The electronics panel 18 may be lifted from the horizontal plane 66 for installation to the control cabinet 14 substantially parallel to the vertical Y-axis 64. In some embodiments, components of the assembled panel 18 (e.g., the control modules 16, rails 50, power supplies 38, and/or cooling systems 40) may cover portions of the inside face 72. Additionally, or in the alternative, the components of different electronics panels 18 may cover different portions of the respective inside face 72. Lifting the electronics panel 18 from a surface (e.g., outside face 74, edges 76) other than the inside face 72 may reduce the interference with the components on the inside face 72. Lifting the electronics panel 18 from lateral edges 88 may reduce interference with fasteners 52 mounting the components to the inside face 72. The recesses 54 on the outside face 74 and/or the edges 76 may facilitate lifting the electronics panel 18 with the lift assembly discussed below. The existing recesses 54 on the outside face 74 and/or the edges 76 may enable the lift assembly to lift the electronics panel 18 regardless of arrangement of components on the inside face 72.

Figure 3:
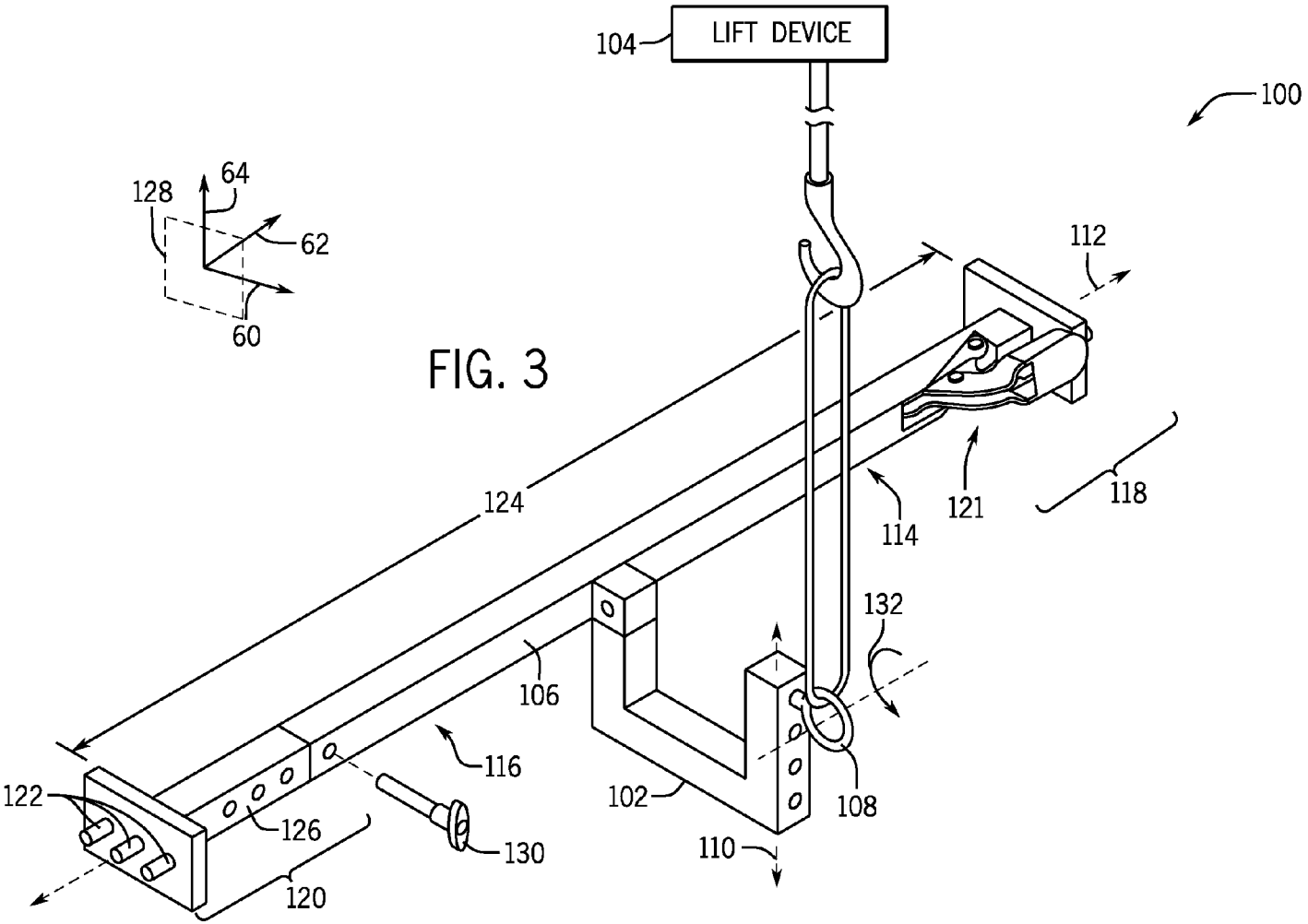
FIG. 3 is a perspective view of an embodiment of the lift assembly.

FIG. 3 illustrates an embodiment of a lift assembly 100 that may be utilized to lift the electronics panels 18 for installation in the control cabinets 14. The lift assembly 100 has a lift member 102 to couple with a lifting device 104 and a support member 106 to couple with the electronics panel 18. The lifting device 104 may be a crane system, a forklift, a pulley, winch, or another system that may raise the lift member 102 via a lift eye 108. The lift eye 108 may be adjustable to various lift points along a lift axis 110 of the lift member 102 to accommodate the weight, center of gravity (CG), and/or installed position of various panels 18. In some embodiments, the lift member 102 has a J-shape, C-shape, or U-shape to extend around a top edge 76 of an electronics panel 18.

The support member 106 is coupled to the lift member 102 and extends along a support axis 112. In some embodiments, the support member 106 is integrally formed with the lift member 102. A first arm 114 and a second arm 116 of the support member 106 extend from the lift member 102 in opposite directions, such as along the support axis 112. A first end portion 118 of the first arm 114 may engage with a first section (e.g., edge 76) of the electronics panel 18, and a second end portion 120 of the second arm 116 may engage with a second section (e.g., edge 76) of the electronics panel 18 opposite the first section. For example, the first end portion 118 may engage with a right lateral edge 88 of the electronics panel 18, and the second end portion 120 may engage with a left lateral edge 88 of the electronics panel 18. In some embodiments, the first and second sections may be sections on opposite sides of the outside surface 74. The first and second end portions 118, 120 may engage with the electronics panel 18 via retaining features 122, such as pins, detents, snaps, and so forth. The retaining features 122 may interface with the recesses 54 of the electronics panel 18. Accordingly, the retaining features 122 of the first and the second end portions 118, 120 may be arranged in a complementary pattern to the recesses 54. The recesses 54 and retaining features 122 have sufficient strength to support the weight of the electronics panel 18 and assembled components (e.g., control modules 16) during a lift.

At least one of the first arm 114 and the second arm 116 is adjustable along the support axis 112 to adjust an arm distance 124 between the first end portion 118 and the second end portion 120. In some embodiments, the first end portion 118 is substantially fixed relative to the lift member 102, and the second end portion 120 is adjustable (e.g., telescopic) along the support axis 112. In some embodiments, the first end portion 118 is coupled to the first arm 114 by a toggle clamp 121. The toggle clamp 121 may enable the first end portion 118 to be toggled between an extended position, such as to engage the electronics panel 18, and a retracted position to disengage the electronics panel 18. The adjustable arm distance 124 enables the lift assembly 100 to be removably coupled to the electronics panel 18 via engaging and/or disengaging the first and second end portions 118, 120. In some embodiments, at least one of the first and second arms 114, 116 is manually adjustable (e.g., telescopic) to adjust the arm distance 124. For example, the second arm 116 may receive varying lengths of a telescoping end 126 of the second end portion 120 to adjust the arm distance 124. As may be appreciated, the second arm 116 and telescoping end 126 may maintain a particular arm distance 124 with a removable key 130, spring detent, twist lock, toggle clamp 121, or other locking mechanism. In some embodiments, the first arm 114 may receive varying lengths of a telescoping first end portion 118 to adjust the arm distance 124. Adjustment of the arm distance 124 enables the lift assembly 100 to have different width configurations to accommodate electronics panels 18 with different widths. In some embodiments, the lift assembly 100 is configured so that the lift axis 110 lies in a substantially vertical plane 128 with the center of gravity of the electronics panel 18 when the lifting device 104 raises the electronics panel 18 via the lift assembly 100. The lift axis 110 may be centered relative to the electronics panel 18 and to the electronics panel axis 68 by adjusting the first and second arms 114, 116.

In some embodiments, both the first arm 114 and the second arm 116 may be (e.g., telescopic) adjustable to removably engage the electronics panel 18 so that the lift axis 110 lies in a substantially vertical plane 128 with the center of gravity of the electronics panel 18. Aligning the lift axis 110 with the center of gravity of the electronics panel 18 enables the electronics panel 18 to be raised substantially vertically along the Y-axis 64, and/or may distribute the weight of the electronics panel 18 substantially equally between the first arm 114 and the second arm 116.

An operator may engage the lift assembly 100 with the electronics panel 18 while the electronics panel 18 is in a horizontal orientation, such as on an assembly table. In the engagement (e.g., horizontal) orientation shown in FIG. 3, the lift device 104 may be attached to the lift eye 108 substantially parallel with the lift axis 110. The operator positions the first end portion 118 and/or the second end portion 120 proximate to the recesses 54 at a top area 82 of the electronics panel 18. The operator then extends first end portion 118 and/or the second end portion 120 to engage the retaining features 122 with the recesses 54. In some embodiments, a key 130 or brace may maintain the engagement of the first and second end portions 118, 120 with the electronics panel 18 during a lift. Upon engagement with the electronics panel 18, the operator may control the lift device 104 to raise the lift assembly 100 and coupled panel 18 along the vertical Y-axis 64. The lift assembly 100 and panel 18 may pivot in a direction 132 about the lift eye 108 as the electronics panel 18 is raised along the vertical axis 64.

The lift assembly 100 may be configured to engage with different surfaces of the electronics panel 18. In some embodiments as shown in FIG. 3, the first and/or second arms 114, 116 may extend (e.g., via axial adjustments) along the support axis 112 to engage an inner edge surface of the electronics panel 18 with retaining features 122 facing outward relative to the lift member 102. In some embodiments, the first and/or second arms 114, 116 may retract (e.g., via axial adjustments) along the support axis 112 to engage an outer edge surface of the electronics panel 18 with retaining features 122 facing inward relative to the lift member 102. Additionally, in some embodiments, the first and/or second arms 114, 116 may extend or retract (e.g., via axial adjustments) along the support axis 112 to engage the outside surface 74 of the electronics panel with retaining features 122 extending through the outside surface 74 of the electronics panel 18.

Figure 4:
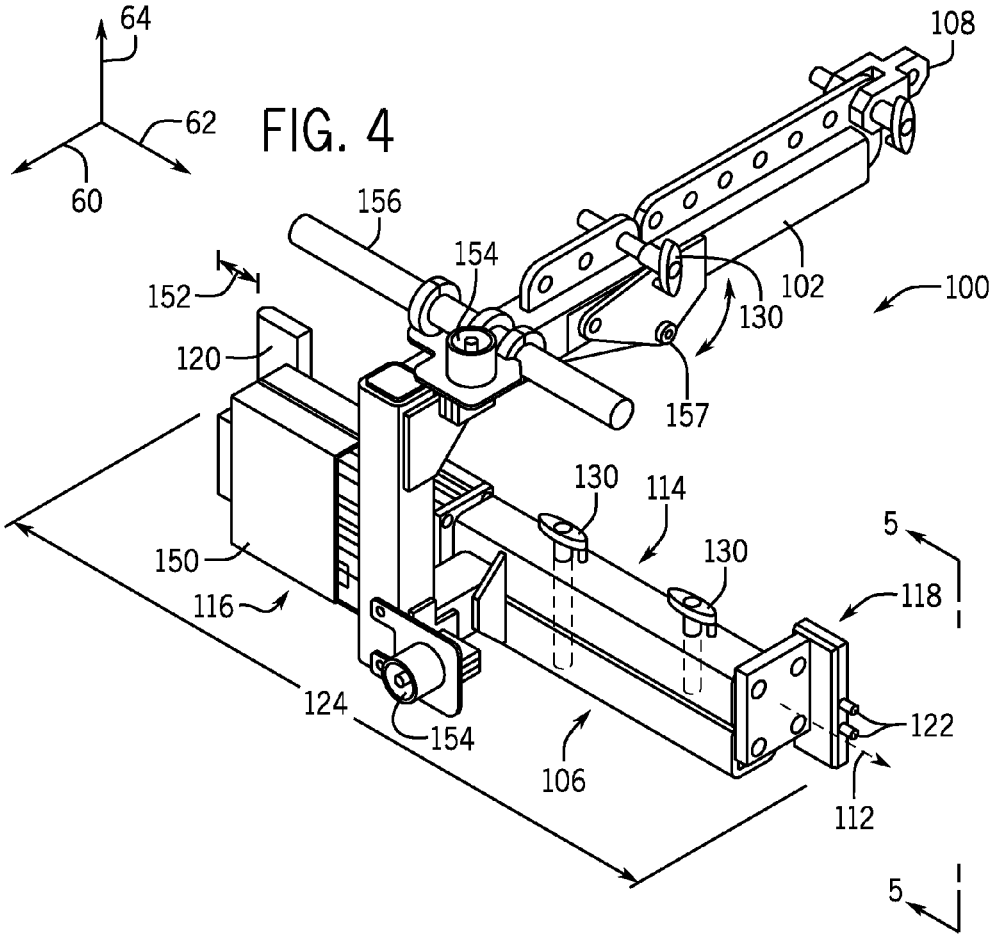
FIG. 4 is a perspective view of an embodiment of the lift assembly.

FIG. 4 illustrates an additional embodiment of the lift assembly 100. In some embodiments, an actuating system 150 moves the first and/or the second arm 114, 116 along the support axis 112. The actuating system 150 may be a mechanical system (e.g., worm gear, pulley, spring), a magnetic system, a hydraulic system, or a pneumatic system, an electrical drive system, (e.g., electric motor drive) or any combination thereof. For example, a fluid (e.g., hydraulic, pneumatic) actuating system 150 may actuate the second arm 116 by extending or retracting a cylinder relative to the lift member 102. In some embodiments, the actuating system 150 may actuate the second arm 116 a distance 152, such as approximately 75 to 100 mm (approximately 3 to 6 inches) or less. In some embodiments, the actuating system 150 adjusts the arm distance 124 approximately the same amount or less than the one or more telescoping ends 126. The telescoping ends 126 may enable rough width adjustments to the lift assembly 100, and the actuating system 150 may enable fine width adjustments to the lift assembly 100. The actuating system 150 may adjust the arm distance 124 to engage and disengage with the electronics panel 18, and the telescoping ends 126 may adjust the arm distance 124 to accommodate different panel widths.

In some embodiments, the first and/or the second arm 114, 116 may be adjustable via one or more keys 130 and the actuating system 150. The keys 130 may enable the operator to configure the lift assembly 100 to different nominal panel sizes, and the actuating system 150 may enable the operator to engage the electronics panel 18 from the nominal panel width. For example, the lift assembly 100 may be configurable to separately engage a narrow (e.g., approximately 1 meter) panel with the key 130 in a first position, and to engage a wide (e.g., approximately 1.5 meter) panel with the key 130 in a second position. With the key 130 in the first position, the arm distance 124 may be less than 1 meter. The actuating system 150 may extend the second end portion 120 an actuating distance to increase the arm distance 124 and engage the first and the second portions 118, 120 with the narrow panel. The same lift assembly 100 may be adjusted via the key 130 to the second position where the arm distance 124 may be less than approximately 1.5 meters. The actuating system 150 may extend the second end portion 120 an actuating distance to increase the arm distance 124 and to engage the first and the second end portions 118, 120 with the wide panel. One or more operator inputs 154 may control the actuating system 150 to extend or retract the second end portion 120.

In some embodiments, the lift assembly 100 has a handle 156 to facilitate positioning the first and second end portions 118, 120 proximate to the recesses 54 of the electronics panel 18. The lift member 102 may be rotatably connected to the support member 106, thereby enabling the lift member 102 to rotate relative to the support member 106. The lift member 102 may have one or more hinges 157 to adjust the shape of the lift member 102. The shape of the lift member 102 may be adjustable to accommodate various lift points for the lift eye 108 along the lift member 102 based at least in part on the weight, center of gravity, or geometry of the electronics panel 18.

Figure 5:
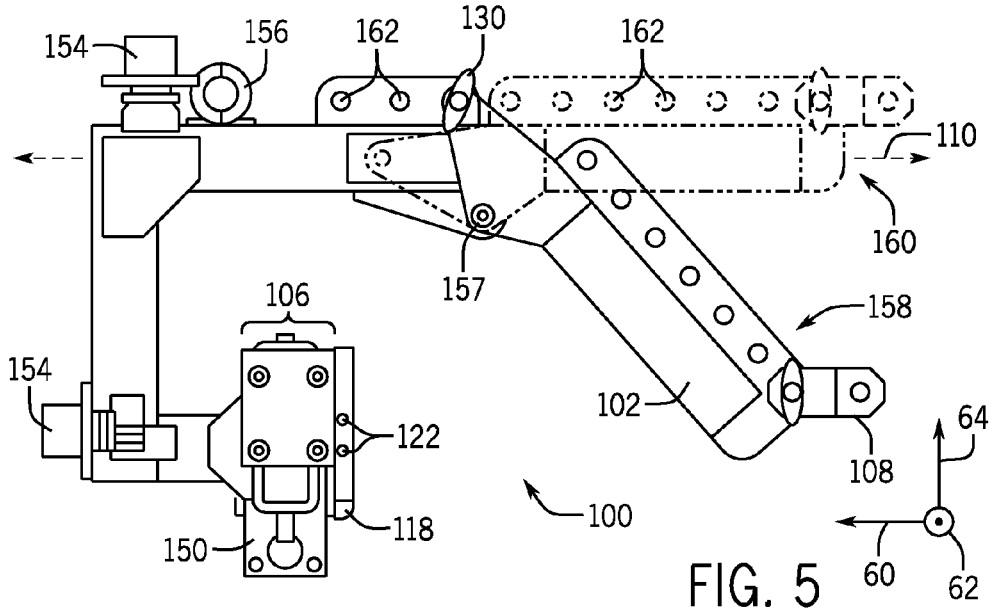
FIG. 5 is a side view of an embodiment of the lift assembly of FIG. 4, taken along line 5-5.

FIG. 5 illustrates a side-view of the lift assembly of FIG. 4 taken along line 5-5. The lift member 102 may be configured in a first position 158 when positioning the lift assembly 100 proximate to the electronics panel 18. The first position 158 may provide for additional flexibility or movement of the lift assembly 100 to place the first and second arms 114, 116 in desired positions relative to panel 18. After the first and second end portions 118, 120 engage the electronics panel 18, the lift member 102 may rotate about the hinge 157 to a second position 160. In some embodiments, the lift member 102 may have an angular range of motion of between approximately 75 to 180 degrees relative to the support member 106. A key 130 may retain the lift member 102 in a desired orientation (e.g., first position 158, second position 160) about the hinge 157. In the second position 160, the lift eye 108 may be removably coupled in various lift points 162 along the lift axis 110 based at least in part on the parameters of the electronics panel 18.

Figure 6:
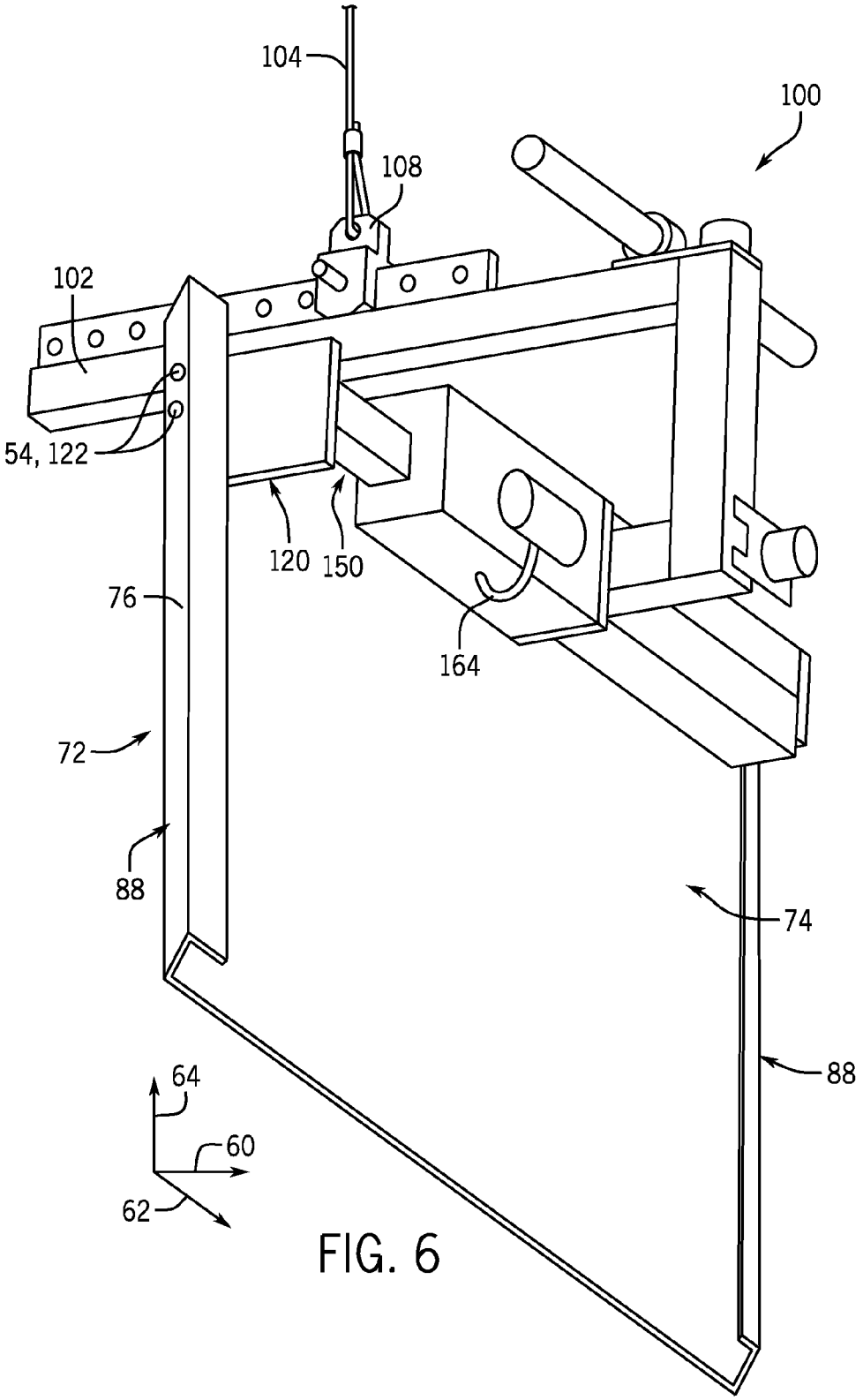
FIG. 6 is a perspective view of an embodiment of the lift assembly engaged with a panel.

FIG. 6 is a perspective view of an embodiment of the lift assembly 100 engaged with an electronics panel 18. The retaining features 122 of the lift assembly 100 interface with the multi-purpose recesses 54 through the inner faces of the lateral edges 88 to suspend the electronics panel 18 from the lifting device 104 substantially along the vertical axis 64. In some embodiments, the lift assembly 100 only engages with the edges 76 and/or the outside surface 74, and does not interface with any of the components on the inside surface 72 of the electronics panel 18. Fluid lines 164 may supply a working fluid (e.g., oil, air) from a reservoir to engage the second end portion 120 with the electronics panel 18. In some embodiments, the lifting device 104 raises the lift assembly 100 and panel 18 along the vertical axis 64 and moves lift assembly and panel 18 along the horizontal axes 60, 62 to position the electronics panel 18 near the control cabinet 14 for installation. In some embodiments, the electronics panel 18 may be secured to the control cabinet 14 prior to disengagement of the lift assembly 100.

Figure 7:
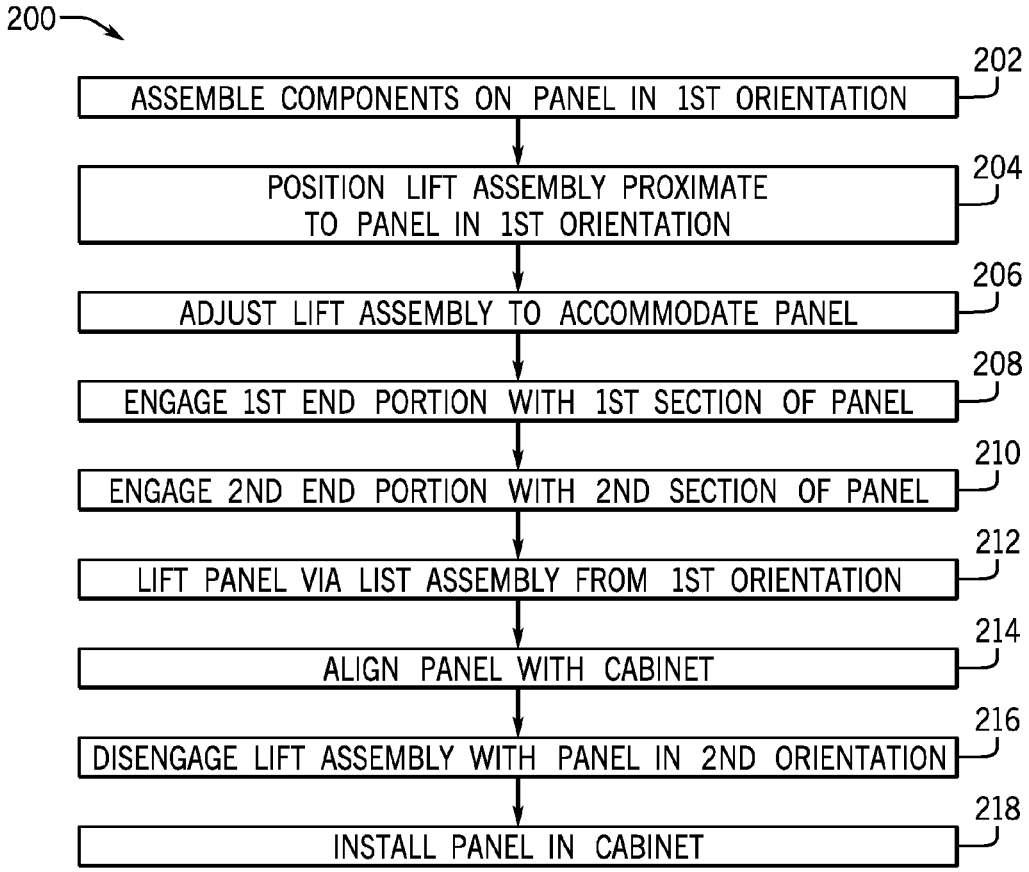
FIG. 7 is a flow chart of a method for installing a panel in a control cabinet with the panel lift assembly.

FIG. 7 illustrates a method 200 of operating the lift assembly 100 described above to install an electronics panel 18 with control modules 16 in a control cabinet 14. The components, such as the control modules 16, power supplies 38, cooling system 40, and rails 50, are assembled (block 202) to the electronics panel 18 in a first orientation. In some embodiments, one or more operators may assemble the components to the electronics panel 18 on a substantially horizontal assembly table. The lift assembly 100 may be positioned (block 204) proximate to the electronics panel 18 while the electronics panel 18 is in the first orientation (e.g., horizontal). The operator may position the lift assembly 100 so that the first end portion 118 and/or the second end portion 120 are proximate to opposite sections (e.g., edges 76) of the top area 82 or bottom area 84 of the electronics panel 18. In some embodiments, the one or more operators may adjust (block 206) the lift assembly 100 to accommodate the geometry of the electronics panel 18. For example, the lift assembly 100 may be reconfigured from a first configuration to engage a narrow panel to a second configuration to engage a wide panel. Additionally or in the alternative, the lift member 102 of the lift assembly 100 may be adjusted to change the shape and/or to change the lift point 162 of the lift eye 108.

The first end portion 118 of the lift assembly 100 is engaged (block 208) with the first section of the electronics panel 18, and the second end portion 120 is engaged (block 210) with the second section of the electronics panel 18. In some embodiments, the lift assembly 100 engages the first and second sections (e.g., opposite lateral edges 76) of the electronics panel 18 substantially simultaneously. The operator may manually engage the first end portion 118 with the first section, and may utilize the actuating system 150 to engage the second end portion 120 with the second section. In some embodiments, retaining features 122 of the lift assembly 100 interface with corresponding recesses 54 of the electronics panel 18. For example, the retaining features 122 may engage the electronics panel 18 via insertion through the recesses 54. Some embodiments of the first end portion 118 and the second end portion 120 may have different arrangements of the retaining features 122 to accommodate different arrangements of the recesses 54 among electronics panels 18. The first and second end portions 118, 120 may be modularly attached to the lift assembly 100. The corresponding recesses 54 may be multi-purpose features of the electronics panel 18, such as for attachment of the electronics panel 18 to the control cabinet 14. In some embodiments, the lift assembly 100 may be adjusted (block 206) after engagement with the electronics panel 18 (blocks 208, 210), such as in preparation for raising the electronics panel 18. For example, the lift member 102 of the lift assembly 100 may be adjusted to change the shape and/or to change the lift point 162 of the lift eye 108. Adjusting the lift point 162 may enable the operator to raise the electronics panel 18 to a desired second orientation for assembly into the control cabinet 14.

After engaging the electronics panel 18 in the first orientation, the lift assembly 100 and the engaged panel 18 are lifted (block 212) via the lifting device 104 coupled to the lift eye 108. The operator utilizes the lifting device 104 to pull the lift assembly 100 along the vertical axis 64, thereby raising the electronics panel 18 from the first orientation. The lift assembly 100 enables one operator to securely raise the electronics panel from the first orientation via the lifting device 104. Additionally, the lift assembly 100 may not contact or interfere with any components on the inside surface 72 of the electronics panel 18. In some embodiments, the first and second arms 114, 116 of the lift assembly 100 may exert opposing forces on the electronics panel 18 (e.g., along the support axis 112) to engage and raise the electronics panel 18 primarily through friction on the lateral edges 76.

The electronics panel 18 is aligned (block 214) with the control cabinet 14 for installation of the electronics panel 18. In some embodiments, the electronics panel 18 is aligned (block 214) prior to lifting (block 212) the electronics panel 18. The lifting device 104 may move the electronics panel 18 along one or more of the coordinate axes 60, 62, 64 to align the electronics panel 18 with the control cabinet 14. In some embodiments, the electronics panel 18 is aligned with the control cabinet 14 so that the bottom area 84 is set in the frame 78 of the control cabinet 14. The lift assembly 100 lifts the top area 82 of the electronics panel 18 to pivot the electronics panel 18 about the bottom area 84 and into the control cabinet 14. The lift assembly 100 may be used to lift the electronics panel 18 from the first orientation to the second orientation for installation. In some embodiments, the second orientation is a substantially vertical orientation that enables the operator to mount the electronics panel 18 within the control cabinet 14 while the lift assembly 100 is engaged. For example, the operator may mount the bottom area 84 of the electronics panel 18 to the frame 78 while the lift assembly 100 is engaged with the top area 82. In some embodiments, the second orientation may be an intermediate orientation between a vertical orientation and a horizontal orientation, such as approximately 5, 10, 15, 20, or 30 degrees offset from the vertical axis 64.

After the electronics panel 18 is aligned (block 214) and lifted to the second orientation, the operator may disengage (block 216) the lift assembly 100 with the electronics panel 18. The electronics panel 18 may be installed (block 218) prior to or after disengagement of the lift assembly 100. In some embodiments, fasteners 52 are installed through the multi-purpose recesses 54 previously engaged by the lift assembly 100. The operator may disengage the lift assembly 100 by adjusting the first and/or the second end portions 118, 120 with the actuating system 150, the key 130, or otherwise adjusting (e.g., decreasing) the arm distance 124. After disengaging (block 216) the lift assembly 100 from the electronics panel 18 in the second orientation, the operator may position (block 204) the lift assembly 100 proximate to a subsequent panel 18 in a first orientation to begin the method 200 for the subsequent panel 18.

The lift assembly described herein enables an operator to lift a control cabinet panel from a first orientation (e.g., horizontal orientation) to a second orientation (e.g., vertical orientation) via multi-purpose recesses without affecting electronic components mounted on the inside surface of the electronics panel. The first and second arms removably engage sections on opposite sides of the electronics panel via pre-existing multi-purpose features (e.g., recesses, holes, edges) of the electronics panel. Accordingly, the lift assembly may engage and lift a control cabinet panel as soon as the components are assembled on the electronics panel without waiting for installation of dedicated lift components to the electronics panel. The lift assembly securely lifts the electronics panel along a vertical axis from above, thereby enabling the lift assembly to reduce the footprint for installation at a work site. An actuator system of the lift assembly may extend and retract the first and/or second end portions to engage the electronics panel. Various features of the lift assembly may be adjustable to engage electronics panels with various widths, weights, and centers of gravity.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system comprising:

a lift member configured to removably couple with a lifting device; and a support member coupled to the lift member, wherein the support member comprises:

a first arm comprising a first end portion configured to removably engage a first edge section of an electronics panel;

a second arm comprising a second end portion offset by an arm distance from the first end portion, wherein the second end portion is configured to selectively move to adjust the arm distance to removably engage a second edge section of the electronics panel opposite to the first edge section, and the first and second end portions are configured to engage the electronics panel in a first orientation, to support the electronics panel during a transition to a second orientation, and to disengage the electronics panel in the second orientation; and an actuation system configured to actuate the second end portion to removably engage the second edge section of the electronics panel opposite to the first edge section.

2. The system of claim 1, wherein the lift member comprises a C-shape.

3. The system of claim 1, wherein the lift member comprises a plurality of lift points configured to removably couple with the lifting device.

4. The system of claim 1, wherein at least one of the first arm or the second arm is adjustable and is configured to adjust the arm distance.

5. The system of claim 1, wherein the actuation system comprises a fluid actuation system.

6. The system of claim 1, wherein the actuation system comprises a toggle clamp.

7. The system of claim 1, wherein the first and second end portions are configured to engage with existing features of the electronics panel, and the existing features are configured to facilitate assembly of the electronics panel with a control cabinet.

8. The system of claim 1, wherein the first orientation comprises a horizontal orientation and the second orientation comprises a vertical orientation.

9. The system of claim 1, comprising the electronics panel configured for a control cabinet, wherein the electronics panel comprises one or more control modules.

10. A system comprising:

a lift member configured to removably couple with a lifting device; and a support member coupled to the lift member, wherein the support member comprises:

a first arm along a first axis comprising a first end portion having a first retaining feature configured to removably engage a first section of an electronics panel;

a second arm along a second axis comprising a second end portion having a second retaining feature configured to removably engage a second section of the electronics panel opposite to the first section; and an actuation system coupled to the second arm, wherein the actuation system is configured to move the second end portion along the second axis to adjust an offset distance relative to the first end portion to selectively engage and disengage the second retaining feature with the second section of the electronics panel;

wherein the first retaining feature and the second retaining feature are configured to engage the electronics panel in a horizontal orientation, to support the electronics panel during a transition to a vertical orientation, and to disengage the electronics panel in the vertical orientation.

11. The system of claim 10, wherein the first retaining feature and the second retaining feature comprise a pin, a detent, an opening, or a recess, or any combination thereof.

12. The system of claim 10, wherein the actuation system comprises an operator interface configured to enable user control of movement of the second end portion along the second axis.

13. The system of claim 10, wherein the support member is axially adjustable to a first width and a second width, wherein the first end portion is offset from the second end portion by a first offset distance in the first width configuration, the first end portion is offset from the second end portion by a second offset distance in the second width configuration, and a difference between the first offset distance and the second offset distance is greater than a maximum axial extension of the actuation system.

14. A method of operating a lift assembly comprising:

positioning the lift assembly proximate to an electronics panel in a first orientation;

engaging a first retaining feature of the lift assembly with a first set of multi-purpose features of a first section of the electronics panel at a first end of the electronics panel;

engaging a second retaining feature of the lift assembly with a second set of multi-purpose features of a second section of the electronics panel opposite the first section at the first end of the electronics panel;

lifting the first end of the electronics panel via the lift assembly from the first orientation to a second orientation perpendicular to the first orientation; and disengaging the first retaining feature and the second retaining feature from the first end of the electronics panel in the second orientation.

15. The method of claim 14, comprising assembling components on the electronics panel in the first orientation, wherein the components comprise a processor, a memory unit, or a sensor, or any combination thereof.

16. The method of claim 14, comprising coupling the electronics panel to a control cabinet via engagement of fasteners through the first and second sets of multi-purpose features.

17. The method of claim 14, wherein engaging the second retaining feature comprises axially moving the second retaining feature via an actuation system.

18. The method of claim 17, wherein the actuation system comprises a fluid actuation system.

19. The method of claim 14, comprising adjusting an offset between the first retaining feature and the second retaining feature to accommodate a width of the electronics panel.

20. The method of claim 14, comprising adjusting the lift assembly after engaging the second retaining feature with the second set of multi-purpose features and prior to lifting the first end of the electronics panel, wherein adjusting the lift assembly comprises changing a shape of the lift assembly, changing a lift point of the lift assembly, or any combination thereof.

* * * * *